United States Patent [19]

Zutell et al.

[11] Patent Number: 4,706,818

[45] Date of Patent: Nov. 17, 1987

[54] MAGNETIC FLATWARE RETRIEVER

[76] Inventors: Stephen W. Zutell, 282 Martin Way, Marietta, Ga. 30064; David A. Wade, 4595 Amberly Ct., Atlanta, Ga. 30360; James V. Hanson, 1005 Willowdale Ave., Kettering, Ohio 45429

[21] Appl. No.: 864,285

[22] Filed: May 16, 1986

[51] Int. Cl.[4] ..... B03C 1/26

[52] U.S. Cl. ..... 209/636; 209/215; 209/223.1; 209/926; 241/46 A; 241/81; 241/100.5

[58] Field of Search ..... 209/636, 930, 213–215, 209/223.1, 223.2, 231, 232, 926; 241/46 R, 46 A, 46 B, 68, 79, 81, 100.5; 335/219, 285, 306; 4/629, DIG. 4

[56] References Cited

U.S. PATENT DOCUMENTS

| | | | |
|---|---|---|---|
| 2,648,434 | 8/1953 | Russell | 209/215 |
| 2,733,812 | 2/1956 | Hoff | 209/223.1 |
| 2,879,949 | 3/1959 | Jordan | 4/DIG. 4 |
| 2,919,803 | 1/1960 | Stem | 209/223.1 |
| 3,149,066 | 9/1964 | Ross | 209/223.1 |
| 3,160,583 | 12/1964 | Stem | 209/223.1 |
| 3,419,224 | 12/1968 | Mlinar | 241/100.5 X |
| 3,662,425 | 5/1972 | Klein et al. | 15/245 |
| 4,279,744 | 7/1981 | Antonwitsch | 209/214 |
| 4,367,138 | 1/1983 | Kustas | 209/224 |
| 4,494,657 | 1/1985 | Oldenkamp | 209/636 |

FOREIGN PATENT DOCUMENTS

| | | | |
|---|---|---|---|
| 2170737 | 8/1986 | United Kingdom | 209/636 |

*Primary Examiner*—Robert B. Reeves
*Assistant Examiner*—Edward M. Wacyra
*Attorney, Agent, or Firm*—Wood, Herron & Evans

[57] ABSTRACT

A device for preventing magnetically attractable flatware and other objects from falling into a food disposer. Round tubes containing magnets are arranged parallel to one another across a collar at the mouth of the disposer. Each tube contains an assembly of cylindrical magnets, separated by spacers, which are magnetized and oriented to provide a strong attractive force around the tube.

7 Claims, 3 Drawing Figures

MAGNETIC FLATWARE RETRIEVER

FIELD OF THE INVENTION

This invention relates to a device for preventing magnetically attractable flatware from falling into a food disposer machine.

BACKGROUND

One of the common hazards of using a garbage disposal machine is that from time to time flatware, i.e., knives, forks, spoons, and other kitchen utensils are inadvertently dropped into the disposer along with the food scraps. These jam the disposer and are usually mangled by it, sometimes so as not to be usable thereafter. At the very least it is difficult to remove them.

It is relatively easy to spot and remove flatware in the relatively small amount of food scraps dumped into a disposer in the home. However, the problem is much more serious in a restaurant or institution where the quantities are larger and the time less. Several hundred dollars of flatware may be lost in the disposer of a restaurant in a single year.

THE PRIOR ART

Apparatus for separating magnetic articles from waste material containing a mixture of magnetic articles and non-magnetic articles are well known in the art. Antonwitsch U.S. Pat. No. 4,279,744, titled "Apparatus and Method for Removing Magnetic Articles From a Flow of Loosely Packed Materials", discloses a magnetic device mounted above a garbage can for recovering flatware from rubbish. The device has an axle with a plurality of magnets spaced axially along it, separated by outwardly projecting, rotatable pole pieces. Magnetically attractive material such as stainless steel flatware, is drawn to and retained on the plate-like pole pieces. The device shown in that patent is particularly adapted for separating flatware from a paper-containing mixture. The rotatability of the pole pieces enables them to better grip flatware even if separated from it by a layer of paper.

Kustas U.S. Pat. No. 4,367,138 discloses another form of magnetic flatware recovery device, in the form of a vertical cylindrical sleeve which is mounted on a cleaning table over a refuse container. This sleeve is hourglass shaped and has a horizontal cross section which is circular, concentric openings at each end thereof, a smooth interior wall, and a reduced diameter portion in the middle. Magnet means are mounted within the interior wall of the device.

BRIEF DESCRIPTION OF THE PRESENT INVENTION

The device of this invention is particularly intended to be mounted above a garbage disposer machine, into which food scraps are scraped from plates. The device comprises an annular collar which is adapted to be seated at the mouth of the machine, the collar having an annular sidewall defining the opening into the machine. At least two smooth, round tubes are mounted in the collar and extend across the opening, each extending from one side to the other thereof. Each tube is a hollow sleeve of non-magnetic material and contains a series of spaced apart, cylindrical permanent magnets which are stacked axially in it. The magnets are separated by non-magnetic spacers, and each has its poles at its opposite end faces, aligned so that the poles on opposing faces of the magnets on each side of a spacer repel each other. The bars are preferably parallel but staggered, that is, one is positioned relatively high in the opening, on one side of the vertical axis of the collar, whereas the other is set lower and on the other side of the vertical axis.

DETAILED DESCRIPTION

Figure 1:
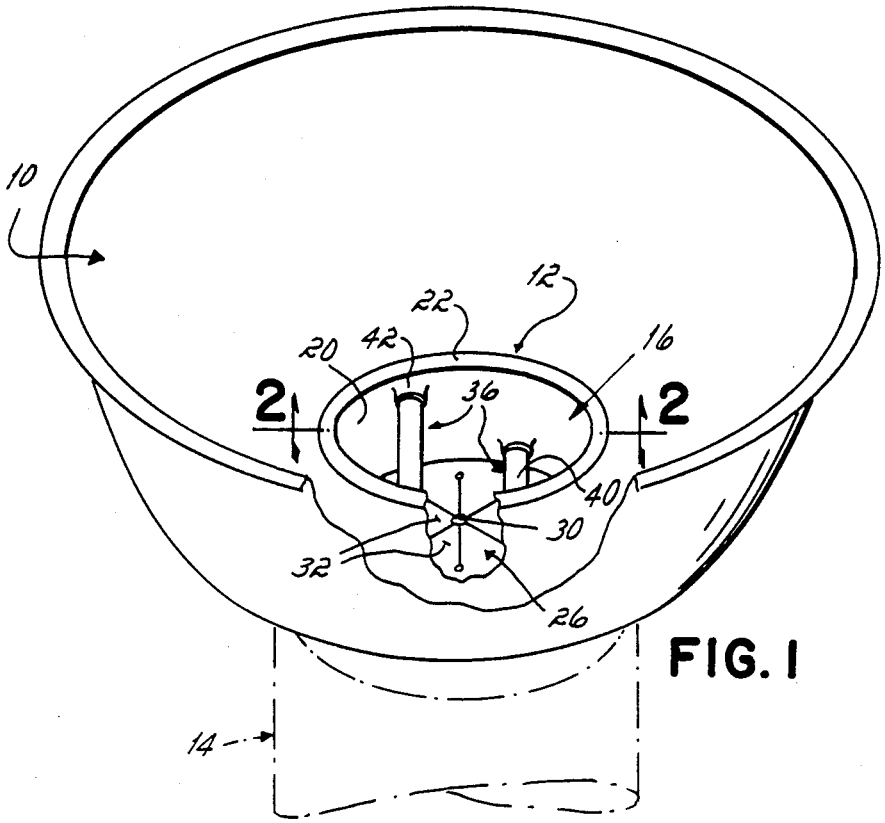
FIG. 1 is a perspective view, partly broken away, of a food disposer unit fitted with a retriever in accordance with a preferred form of the invention.

In FIG. 1, a disposer bowl 10 is shown having a central opening or mouth 12 leading downwardly into a garbage disposer machine 14, which may be of a type known per se. The present device is most suited for use with institutional or commercial sized disposers having an intake opening about 5" or more in diameter, although it can also be used with smaller residential sized units.

At the mouth 12 of the disposer a collar 16 is seated. This collar is of what may be referred to as an inverted hat shape, having an annular, cylindrical side wall 20, a horizontal outwardly extending flange 22 at the top, and an inturned lip 24 at the bottom (see FIG. 2) on which a flexible baffle 26 is seated. Collar 16 is preferably molded of a non-magnetic plastic material such as nylon. Food is introduced into the disposer 14 through this collar.

Baffle 26, seated on the inturned lip 24 at the bottom of the collar, is generally circular in plan and has a central opening 30 and a series of flaps 32 defined by radial slits between them. The baffle, which is known per se, is provided to prevent upward splash when the disposer is in operation and to retard the movement of objects past the flaps and into the disposer.

Figure 2:
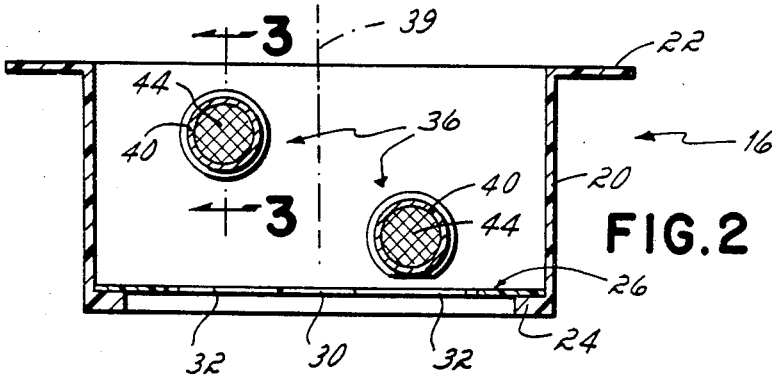
FIG. 2 is an enlarged vertical section taken on line 2—2 of FIG. 1.
Figure 3:
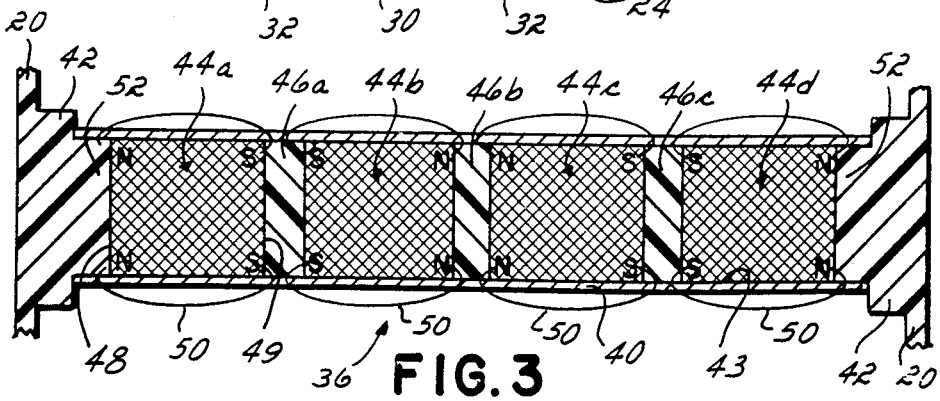
FIG. 3 is an enlarged vertical cross section taken on line 3—3 of FIG. 2, diagrammatically showing the magnetic lines of flux.

The magnetic retriever elements of the invention are designated at 36 and in preferred embodiment comprise two parallel, horizontal, vertically staggered members set on opposite sides of the imaginary centerline 39 or vertical axis of the collar (see FIG. 2). Each member 36 contains a series of permanent magnets, to be described, which magnetically attract and hold stainless steel or steel based objects to them. In the embodiment shown each element 36 is formed of a non-magnetic cylindrical tube 40 which is received and positioned on inwardly projecting bosses 42, 42 formed on the wall 20 of collar 16. Each tube 40 has a relatively thin sidewall and receives stacked within its hollow interior 43 a series of cylindrical or disk-like permanent magnets 44*a, b, c,* and *d* (FIG. 3), which are stacked axially end to end and separated one from another along the length of the axis of tube 40 by non-magnetic spacers 46*a, b* and *c.*

For use with a typical commercial disposer each tube 40 may be about five inches long; preferably four such magnets are provided in each tube, each about one inch long and $\frac{7}{8}$" diameter. The non-magnetic separators are of the same nominal diameter but are only $\frac{1}{4}$" long (axial dimension). The magnets should be of a permanently magnetic material having a high BH max (energy product). Barium ferrite magnets sold under the "Ferroxdure" mark are suitable.

We have found that specially good results are obtained if each magnet is magnetized so that its poles are on its end faces 48 and 49, with the axis of magnetization parallel to the axis of the tube; and further if the magnets are arranged so that faces have like poles oppose one another on opposite sides of each spacer. If this is done, the magnet lines of force (indicated diagrammatically at 50 in FIG. 3) extend outside tube 40 from one face of each magnet 48 to the other face 49, and exert an especially strong attractive force on the flatware.

It is further preferred that the two magnetic elements 36, 36 are vertically staggered, that is, they are not at the same vertical elevation in the collar opening. One should be on one side of the vertical axis 39 and higher than the other.

The bosses 42 are formed as cylindrical projections on the inside of the sleeve, each having an inwardly extending seat 52 which is sized to project into and be received within the interior of the tube to hold the tube in place and to position the series of magnets spacers against movement in the tube.

The manner in which magnetically attractive flatware is retrieved by the present device will now be apparent. Food scraps dumped into the disposer bowl 10 drop through collar 16 past the elements 36. Any flatware that has gotten mixed with the scraps is attracted to one of the bars or tubes is held by it. The second bar thereupon tends to grab another end of the flatware so that the article is held across the two bars, does not fall into the disposer, and can easily be removed.

In addition to retrieving magnetically attractable objects, the bars 40 physically prevent an operator from reaching into the disposer. The elements 36, 36 should be spaced so as to block movement of a hand past them. This provides a good safety precaution against injury.

The baffle 26 at the bottom of the collar is preferably made of a material such as polyurethane. Its flaps 32 may eventually wear and break off as they are repeatedly flexed. If this occurs, they are rapidly ground up by the disposer. The baffle can readily be removed from its seat on lip 24 and replaced.

The collar is preferably made sufficiently flexible and resilient that it can be deformed by the application of compression in the direction transverse to the tube 40 so that it becomes elongated sufficiently that the seats 42, 42 move apart by an amount adequate that the tube can be installed between them or removed from them. Upon release of the compressing force the collar resiliently returns to a circular shape and the seats hold the tubes securely.

Tests of this device show that it is remarkably effective in retrieving flatware. The smooth, rounded shape of the tubes permits food scraps to slide past them easily; they do not retain food particles and they are adapted for easy cleaning as required in restaurants.

Having described the invention, what is claimed is:

1. A magnetic device for preventing flatware from falling into a food disposer machine, comprising, a non-magnetic collar adapted to be mounted over the mouth of the machine, said collar having an annular wall defining a vertical opening for the passage of food scraps into the machine, and at least two magnetic elements mounted by said collar in said opening, each element extending across said opening from one side thereof to an opposite side, each element comprising a round, smooth, hollow, cylindrical non-magnetic sleeve containing a series of permanent magnets aligned axially within it, said magnets separated from each other by non-magnetic spacers, said collar having mounting means projecting into said opening from said wall, said mounting means positioned and sized for seating and capturing the ends of the respective sleeves, said collar deforming outwardly in a direction parallel to said elements and away from said ends if a compressive force is applied thereto transversely to said elements, thereby to enable said sleeves to be seated on and captured by said mounting means when the compressive force is removed.

2. The device of claim 1 wherein each magnet has parallel end faces which are perpendicular to the axis of the respective element, each magnet having its opposite magnetic poles on its respective end faces.

3. The device of claim 2 wherein magnets on opposite sides of a spacer are oriented to repel each other, and the magnetic lines of flux extend outside of said sleeve.

4. The device of claim 1 wherein said collar is of inverted hat-shaped and comprises a horizontal outer flange for seating in a bowl, said flange extending outwardly around the top of said wall, and an inturned lip at the bottom end of said wall on which a flexible baffle is seated.

5. The device of claim 1 wherein said mounting means comprises opposed pairs of bosses on said wall, said bosses sized and positioned to project into the ends of said sleeves to position and secure them and to confine the series of magnets in the interior of said sleeve.

6. The device of claim 1 wherein said collar mounts two such elements in parallel horizontal position, each element extending across said opening, said elements positioned on opposite sides of the center of said vertical opening.

7. The device of claim 6 wherein said elements are staggered vertically, one being above the other, each being off center in said opening.

* * * * *